US008698024B2

(12) United States Patent
Woodson

(10) Patent No.: US 8,698,024 B2
(45) Date of Patent: Apr. 15, 2014

(54) PRESSURE SENSITIVE TRIP MECHANISM WITH DEBRIS CONTROL

(75) Inventor: Cameron L. Woodson, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 265 days.

(21) Appl. No.: 13/299,910

(22) Filed: Nov. 18, 2011

(65) Prior Publication Data

US 2013/0126316 A1 May 23, 2013

(51) Int. Cl.
*H01H 3/20* (2006.01)

(52) U.S. Cl.
USPC ..... 200/332; 200/149; 200/400; 335/16; 335/172

(58) Field of Classification Search
USPC ..... 200/149, 332, 400; 335/16, 172
See application file for complete search history.

(56) References Cited

U.S. PATENT DOCUMENTS

| | | | | |
|---|---|---|---|---|
| 3,631,369 | A | 12/1971 | Menocal | |
| 3,997,746 | A | 12/1976 | Harper et al. | |
| 5,103,198 | A | 4/1992 | Morel et al. | |
| 5,298,874 | A | 3/1994 | Morel et al. | |
| 6,313,425 | B1 * | 11/2001 | Doughty et al. | 218/149 |
| 6,429,759 | B1 * | 8/2002 | Schlitz et al. | 335/16 |
| 6,476,337 | B2 * | 11/2002 | Castonguay et al. | 200/400 |
| 6,919,785 | B2 * | 7/2005 | Douville et al. | 335/172 |
| 7,633,365 | B2 | 12/2009 | Harmon et al. | |
| 2012/0168292 | A1 * | 7/2012 | Woodson et al. | 200/332 |

FOREIGN PATENT DOCUMENTS

DE 102009015222 A1 10/2010

OTHER PUBLICATIONS

International Search Report corresponding to co-pending International Patent Application Serial No. PCT/US2012/065146, European Patent Office, dated Feb. 27, 2012; (5 pages).
International Written Opinion corresponding to co-pending International Patent Application Serial No. PCT/US2012/065146, European Patent Office, dated Feb. 27, 2013;(6 pages).

* cited by examiner

*Primary Examiner* — Truc Nguyen
(74) *Attorney, Agent, or Firm* — Locke Lord LLP

(57) ABSTRACT

A pressure sensitive circuit breaker trip unit has a case forming a gas receiving cavity and a cavity accommodating movement of an actuator body with a trip lever. The actuator is moved by pressure of circuit interruption gases entering the gas receiving cavity. The actuator body has a hollow therein for accepting the interruption gases and accompanying hot debris thereby reducing any fouling of the movement accommodating cavity which may impede movement of the actuator body on subsequent circuit interruptions.

20 Claims, 4 Drawing Sheets

PRESSURE SENSITIVE TRIP MECHANISM WITH DEBRIS CONTROL

FIELD OF THE INVENTION

The present disclosure relates generally to a pressure sensitive trip unit for a circuit breaker, and, more particularly, to a mechanism for reducing the effects of arcing debris in a pressure trip actuated molded case circuit breaker following a trip event that might foul an internal surface of the breaker.

BACKGROUND

A molded case circuit breaker (MCCB) can incorporate a pressure sensitive trip mechanism, or hereinafter a pressure trip mechanism, to detect over current events and trip the breaker. Internal to the MCCB, an interruption module houses two electrical contacts that are configured to separate due to electrodynamic forces generated when the current flowing through the contacts is excessively high. When the contacts separate, an arc occurs as the air between the contacts ionizes and electrical energy arcs between the contacts. The energy released during the arc heats the gas in the interruption module and increases the pressure therein. The interruption module housing the contacts is sometimes referred to as a breaking unit. The breaking unit is in fluid communication with the pressure trip mechanism, which is a case having chambers or cavities that house a movable surface which moves in response to the pressure increase communicated from the breaking unit. In some breakers, the movable surface is a piston moving within a cylinder and thus such units are sometimes traditionally called a piston trip unit. In other breakers, the movable surface is one side of a lever that pivots when the pressure increases. The movement of the movable surface then activates a trip mechanism through a mechanical linkage. The trip mechanism can be configured to break multiple poles of an electrical circuit simultaneously. Such an MCCB generally incorporates exhaust vents for venting the high pressure gas following the activation of the trip mechanism.

An MCCB incorporating a pressure trip mechanism generally incorporates a bias for biasing the movable surface in a normal operating position. A pressure trip mechanism module incorporating a bias is disclosed in U.S. Pat. No. 5,298,874 to Morel et al. A spring can be used to bias the movable surface. During the arc, the movable surface moves against the force of the bias to activate the trip mechanism due to the high pressure created by the heated gas. Once the trip mechanism is activated, the arc halts. With the gasses no longer heated, the pressure in the breaking unit returns to normal. The return of normal pressure may be assisted by venting the heated gas into exhaust vents. After the pressure has stabilized, the bias causes the movable surface to return to the normal operating position.

Occasionally, however, the interior surface of the trip unit that the movable surface moves along is damaged during the arc fault event by hot gasses and molten metallic debris generated during the arc. Hot gasses and debris can become imbedded in the interior surfaces or otherwise foul the interior surface. The damage to the interior surface can impede the movement of the movable surface as it is returned to its normal operating position under the force of the bias. When the force of the bias is unable to return the movable surface to its normal operating position due to the fouled interior surface, the MCCB may trip while operating or otherwise malfunction.

BRIEF SUMMARY

Provided herein is an apparatus for minimizing fouling in a pressure trip mechanism incorporated in an electrical circuit breaker. According to one configuration of the present disclosure, the pressure trip mechanism can be a case or container comprising a first gas intake cavity, a second cavity for holding an actuator body and allowing movement of the actuator body therein, a trip actuator having a body with a hollow therein and an attached or integral trip lever, the actuator body being located in the second cavity; a barrier wall impermeable to the gases between the first cavity and the second cavity; and a pipe or channel through the barrier wall communicating from the first cavity into the hollow of the actuator body. The majority of gas-carried debris from the circuit interruption will then be captured and cooled in the interior hollow of the actuator body rather than fouling or distorting a bearing surface of the second cavity or the actuator body which could affect movement of the trip actuator.

In one configuration a pressure trip mechanism for actuating a circuit breaker may comprise a case defining a cavity and a gas inlet port to the cavity, the cavity defining a gas intake area, the gas intake area having an outlet. An actuator having a lever for operating a trip mechanism, and a body portion movably is fitted in the case. The body portion has a hollow therein, and the body portion hollow has an inlet facing the gas intake area outlet in close proximity when the actuator is in a rest position, whereby during a circuit interruption, the actuator body portion hollow helps capture interruption gases and associated debris while the actuator is being moved by pressure of said gases to affect the trip.

In one configuration a pressure trip mechanism for actuating a circuit breaker, comprises a case defining a cavity and a gas inlet port to the cavity, the cavity defining a gas intake area and an actuator movement area, the gas intake area having an outlet tube. An actuator defining a trip lever and a body portion is slidably fitted in the actuator movement area, the body portion has a hollow therein and a gas inlet orifice communicating with the hollow, the gas inlet orifice surrounding the outlet tube when the actuator is in a rest position and preferably throughout its range of motion under pressure, whereby during a circuit interruption, the actuator hollow captures interruption gases and associated debris.

The hollow of the actuator body may have various configurations in different aspects of the invention. For example, the hollow may comprise a straight bore for receiving the outlet tube from the first cavity. In some aspects, the hollow may have various serpentine passages and cavities for accepting the gases. In some aspects, the hollow may contain debris controlling material for helping capture the debris within the hollow.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

By way of general discussion, and as known to those in the art, a pressure trip mechanism of the type discussed herein would typically operate a molded case circuit breaker. Such a molded case circuit breaker generally has a base with interior compartments for containing the multiple interrupter modules and the operating mechanism module which drives the interrupter modules by common drive pins. A cover or covers are coupled to the base over the interrupter modules. The handle of the circuit breaker is attached to the operating mechanism and extends through the cover to give the operator the ability to turn the circuit breaker on to energize a protected circuit or off to disconnect the protected circuit, or to reset the circuit breaker after it trips to protect the circuit. A plurality of line-side contact and load-side straps will extend through the case for connecting the circuit breaker to the intended electrical conductors. A general description and illustration of these known parts of the circuit breaker as a whole can be found in U.S. Pat. No. 6,965,292 or the above-identified U.S. Pat. No. 5,298,874, for the edification of the reader should such be needed, but will not be further discussed herein.

Figure 1:
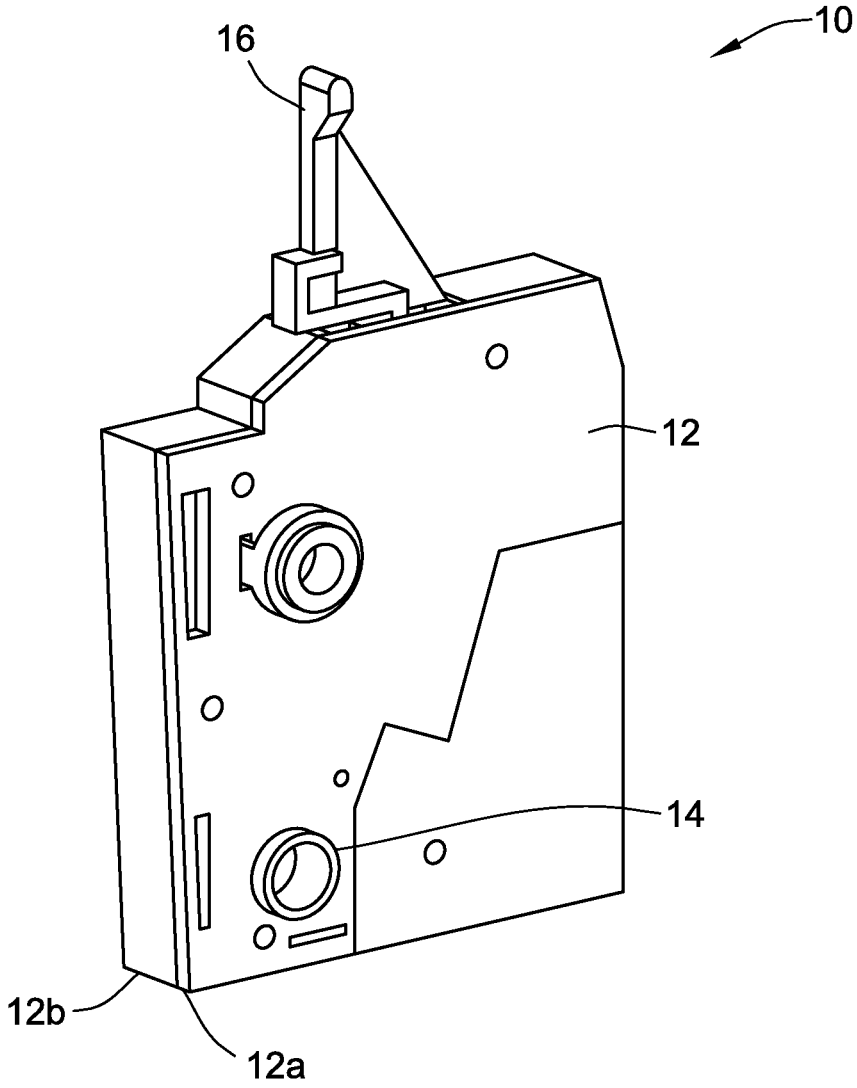
FIG. 1 is a side perspective view of a pressure trip mechanism according to certain aspects of the present invention.

Referring to FIG. 1, an exemplary pressure trip mechanism 10 is shown. The case 12 of the mechanism is comprised of two case halves or base member and cover, respectively 12*a*, 12*b*, fitted together. The case halves have a gas inlet throughport 14 for accepting interruption gases flowing from the interrupter modules of the breaker (not shown) due to overpressure created by arcing at the opened contacts. Each port 14 would typically be covered by a known fiber check valve mechanism (not shown) that opens and then closes with the release of pressure allowing the port on one side of the case to admit higher pressurized gas while closing the port of the other case half. Other details of the trip mechanism not necessary to the exposition of the present invention will be omitted herein. A trip lever 16 of the actuator (FIG. 2) extends outside of the case 12.

Figure 2:
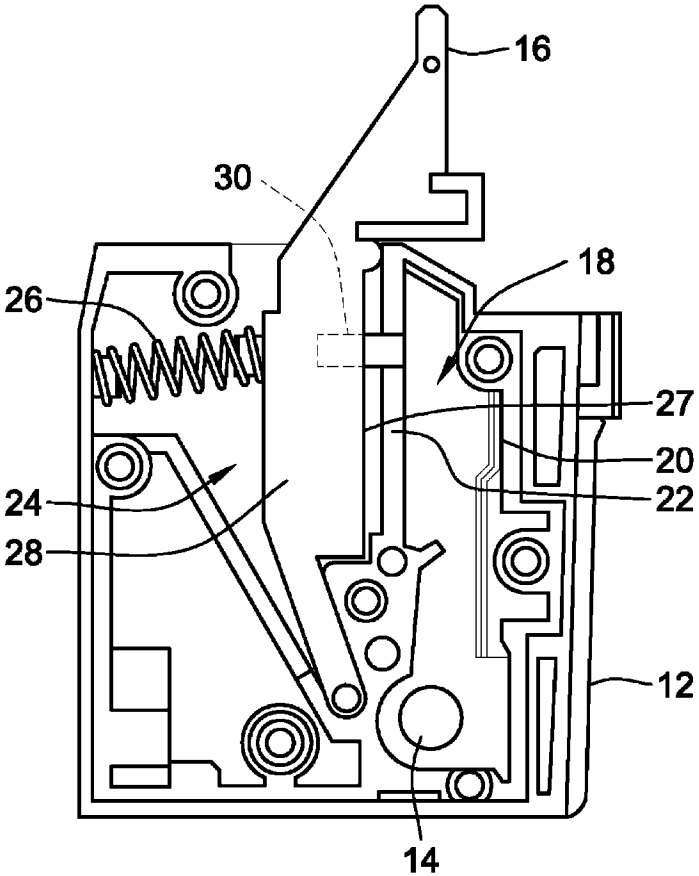
FIG. 2 is a side view of the pressure trip mechanism of FIG. 1 with a case wall removed with the actuator in the rest position.

Referring to FIG. 2, one half of the case 12 is removed to show the interior of the mechanism 10. The case 12 forms first gas intake cavity 18 between an interior front wall 20 and interior barrier wall 22 and communicating with the gas inlet port 14. On the other side of the barrier wall 22 is a second cavity 24 formed in the case for holding an actuator body 28 which includes the trip lever 16 integrally formed therein as a part of the breaker trip mechanism (not shown). The trip actuator body has a hollow 32 (FIG. 4) therein, as further explained below.

Figure 3:
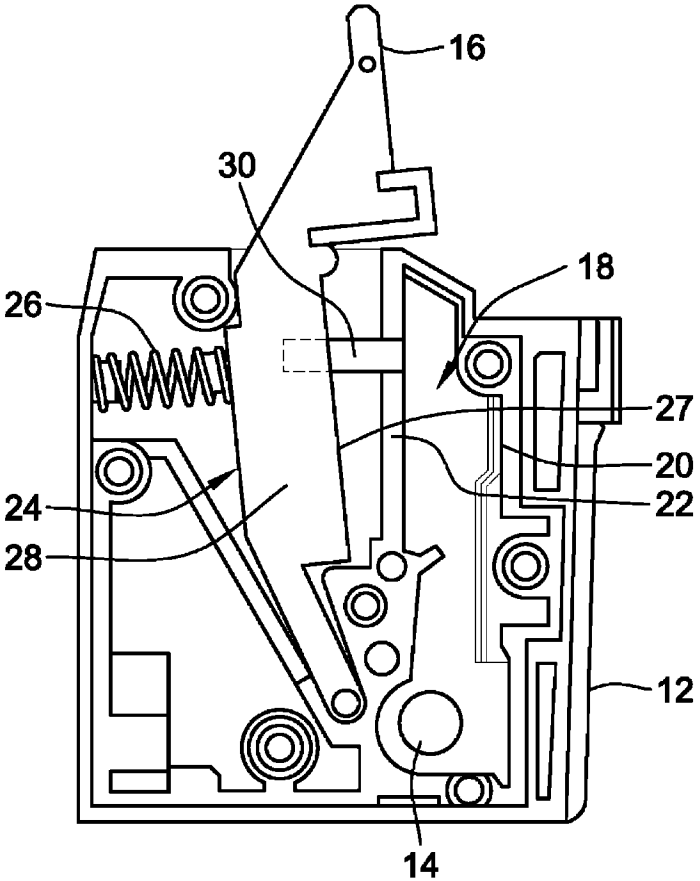
FIG. 3 is a side view of the pressure trip mechanism with a case wall removed with the actuator in the breaker-tripped position.

The second cavity 24 allows movement, such as pivoting shown here, of the actuator body 28, with its trip lever 16 thereon, between a first at rest position as shown if FIG. 2 and a second activated position as shown in FIG. 3 wherein the actuator body 28 and its trip lever 16 have been forced rearward under pressure of the interruption gases to make the trip lever 16 activate the breaker trip mechanism. A biasing spring 26 biases the actuator body 28 towards the rest position where the forward surface 27 of the actuator body 28 is in close proximity to the barrier wall 22.

The barrier wall 22 is gas impermeable with an opening 29 therein between the first cavity 18 and the second cavity 24. The opening may be, or may include, a pipe 30 through the barrier wall 22 communicating from the first cavity 18 into the hollow 32 of the actuator body. The pipe 30 may be a fitted piece placed in a formed hole as shown or the pipe may be formed integrally with the case 12. The pipe 30 as illustrated fits into the actuator hollow 32 and is intended to remain substantially inside the hollow 32 through the range of motion of the actuator body 28, thereby providing a direct path for interruption gases and debris into the hollow and keeping the second cavity 24 free from contamination and fouling which might otherwise impede movement of the actuator body 28.

Figure 4:
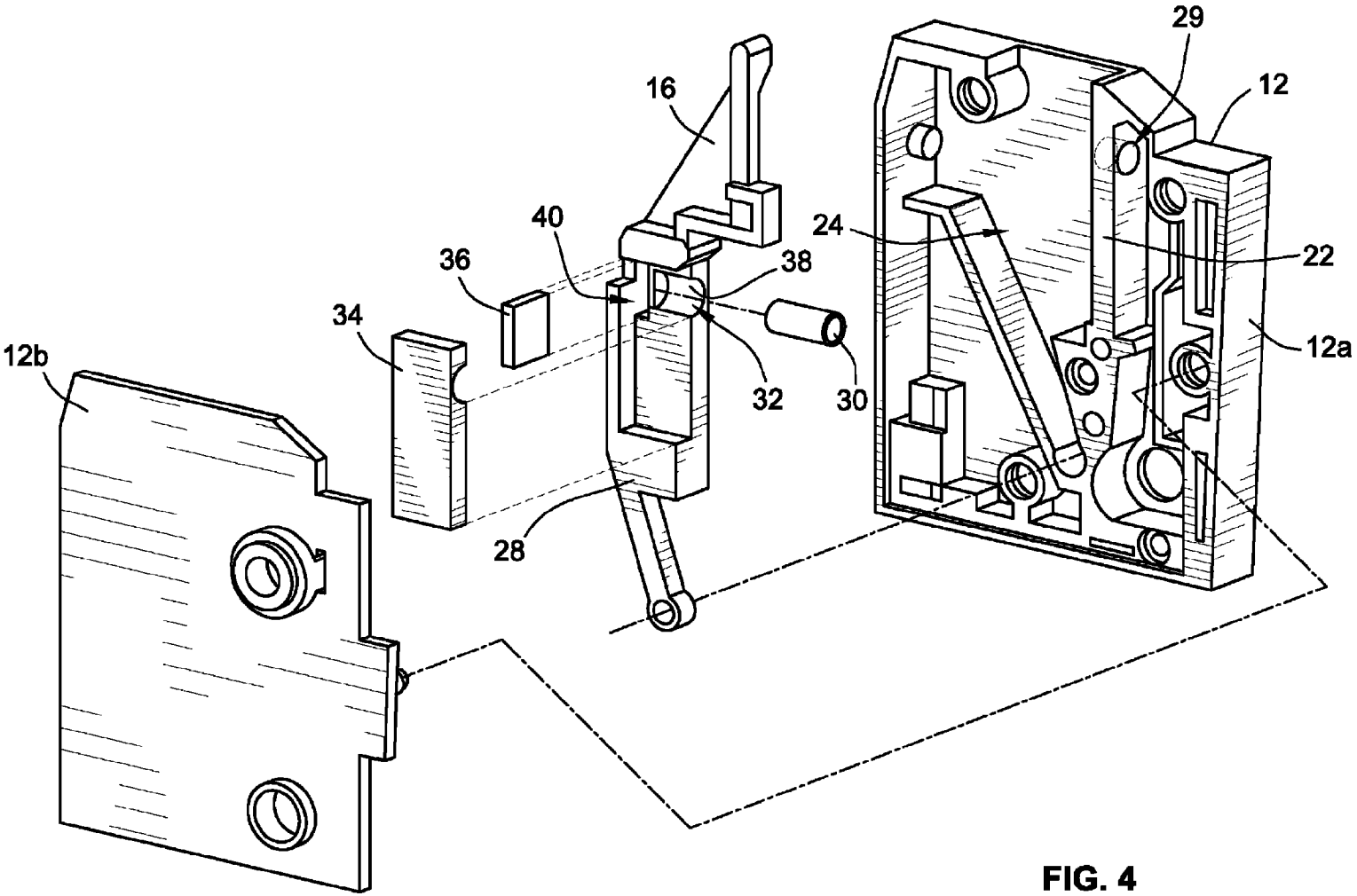
FIG. 4 is an exploded view of the exemplary pressure trip mechanism.

As further seen in FIG. 4, the hollow 32 of the actuator body 28 is formed by a cover 34 secured to the body 28 and includes a straight bore 38 and a slot 40 for containing a pad of debris controlling material 36. This construction will allow the debris controlling material 36 such as a steel wool or other selected material to be placed in the body 28, if desired, to trap and cool the gas-carried debris and sequester it in the body 28. Care will be taken to ensure that the debris controlling material 36 does not interfere with the physics of the actuator body 28 movement. Alternately, it is conceivable that the actuator body might have a pipe thereon from the hollow opening and extended through the opening 29 of the barrier wall or the pipe may not be needed in some aspects of the invention. It will be appreciated that the design of the various parts and chambers illustrated may be modified to enhance various performance characteristics of the pressure trip mechanism.

Figure 7:
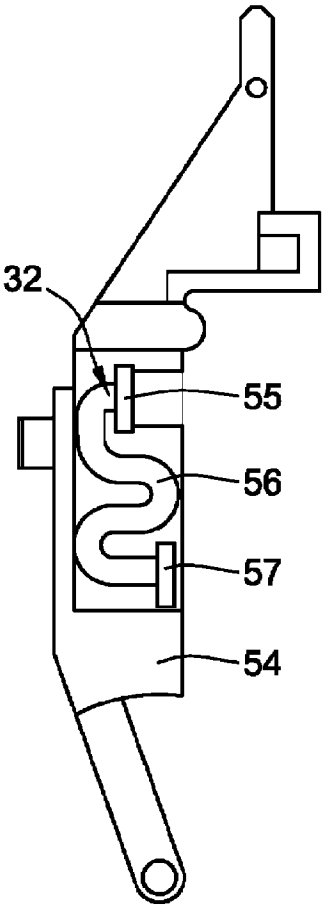
FIG. 7 shows an alternative aspect of the actuator body wherein the hollow includes a first screen chamber and a second end chamber for debris controlling material.
Figure 6:
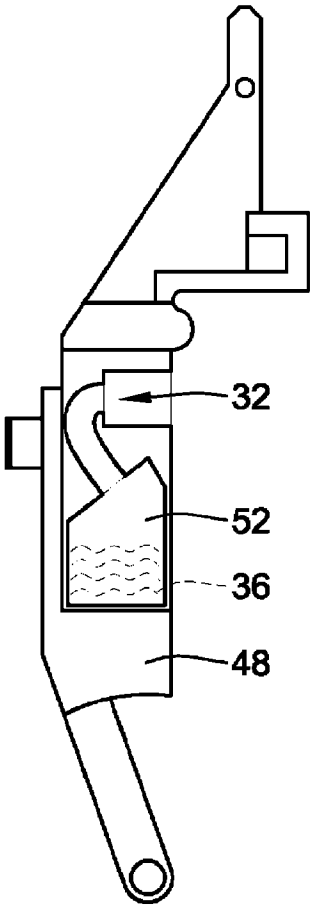
FIG. 6 shows an alternative aspect of the actuator body wherein the hollow includes a curved passage with a large end chamber.
Figure 5:
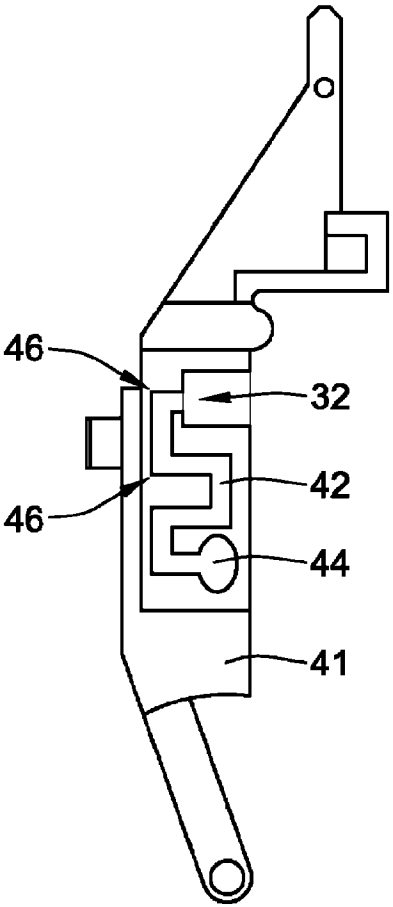
FIG. 5 shows an alternative aspect of the actuator body wherein the hollow includes a serpentine passage with an end chamber.

For example in FIG. 5 an alternative aspect of the actuator body 41 is shown wherein the hollow 32 includes a serpentine passage 42 with an end chamber 44. The serpentine passage 42 contains right angle changes of direction 46 to help slow the gas and debris. The walls of the end chamber 44 may be relied on to fuse with the hot debris or the end chamber may contain debris controlling material (not shown). In another aspect of the invention, FIG. 6 shows an alternative aspect of the actuator body 48 wherein the hollow 32 includes a curved passage 50 with a large end chamber 52 suitable for holding a quantity of debris controlling material 36. FIG. 7 shows an alternative aspect of the actuator body 54 wherein the upstream portion of the hollow 32 includes a first screen chamber 55 which can hold a metal screen (not shown) as a first debris controlling material. A serpentine passage 56 leads downstream of the screen chamber 55 and ends in a second end chamber 57 for additional debris controlling material (not shown) which may be different than the first debris controlling material.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A pressure trip mechanism for actuating a circuit breaker, comprising:

a first gas intake cavity, a second cavity for holding an actuator body and allowing movement of the actuator body therein, a trip actuator having a body with a hollow and a trip lever, the actuator body located in the second cavity;

a barrier wall between the first cavity and the second cavity a pipe through the barrier wall communicating from the first cavity into the hollow of the actuator body.

2. The pressure trip mechanism according to claim 1 wherein the actuator body is pivotable.

3. The pressure trip mechanism according to claim 1 wherein the actuator body has a cover over the hollow.

4. The pressure trip mechanism according to claim 3 wherein the cover is removable.

5. The pressure trip mechanism according to claim 1 wherein the hollow contains debris catching material.

6. The pressure trip mechanism according to claim 3 wherein the hollow contains debris catching material.

7. The pressure trip mechanism according to claim 1 wherein the actuator body has a range of motion and the pipe remains inside the hollow throughout the range of motion of the actuator body.

8. A pressure trip mechanism for actuating a circuit breaker, comprising:

a case defining a cavity and a gas inlet port to the cavity, the cavity defining a gas intake area, the gas intake area having an outlet;

an actuator having a trip lever and a body portion movably fitted in the case, the body portion having a hollow therein, the body portion hollow having an inlet facing the gas intake area outlet in close proximity when the actuator is in a rest position, whereby during a circuit interruption, the actuator body portion hollow captures interruption gases and associated debris while the actuator is being moved by pressure of said gases.

9. The pressure trip mechanism according to claim 8 wherein the hollow includes a serpentine passage.

10. The pressure trip mechanism according to claim 8 wherein the hollow includes a chamber.

11. The pressure trip mechanism according to claim 9 wherein the hollow includes a chamber.

12. The pressure trip mechanism according to claim 9 further including a debris controlling material in the chamber.

13. A pressure trip mechanism for actuating a circuit breaker, comprising:

a case defining a first cavity and a gas inlet port to the first cavity, the first cavity defining a gas intake area, the case further defining a second cavity and a barrier wall between the first cavity and the second cavity, the barrier wall having a hole communicating between the first cavity and the second cavity;

an actuator having a lever extending outside the case and a body portion movably fitted in the second cavity, the body portion having a hollow therein, the body portion hollow having an inlet facing the hole in close proximity when the actuator is in a rest position, whereby during a circuit interruption, the actuator body portion hollow captures interruption gases and gas-carried debris while the actuator is being moved by pressure of said gases.

14. The pressure trip mechanism according to claim 13 wherein the actuator is pivotable.

15. The pressure trip mechanism according to claim 13 wherein the actuator body portion has a cover over the hollow.

16. The pressure trip mechanism according to claim 15 wherein the cover is removable.

17. The pressure trip mechanism according to claim 13 wherein the hollow contains debris catching material.

18. The pressure trip mechanism according to claim 15 wherein the hollow contains debris catching material.

19. The pressure trip mechanism according to claim 13 wherein the hole further includes a pipe.

20. The pressure trip mechanism according to claim 19 wherein the actuator has a range of motion and the pipe remains inside the hollow throughout the range of motion of the actuator body.

* * * * *